US007534178B2

(12) United States Patent
Nicely

(10) Patent No.: US 7,534,178 B2
(45) Date of Patent: May 19, 2009

(54) BASEBALL BATTER TRAINING SYSTEM

(76) Inventor: Timothy J. Nicely, 5529 Highway 11W South, Bean Station, TN (US) 37708

( * ) Notice: Subject to any disclaimer, the term of this patent is extended or adjusted under 35 U.S.C. 154(b) by 0 days.

(21) Appl. No.: 11/623,462

(22) Filed: Jan. 16, 2007

(65) Prior Publication Data

US 2008/0171619 A1 Jul. 17, 2008

(51) Int. Cl.
*A63B 69/00* (2006.01)
*A63B 69/40* (2006.01)

(52) U.S. Cl. ..... 473/453; 473/422; 473/421; 473/454

(58) Field of Classification Search ..... 473/422, 473/453, 454, 421
See application file for complete search history.

(56) References Cited

U.S. PATENT DOCUMENTS 504,887 A * 9/1893 Moore ..... 248/113
708,569 A * 9/1902 Manley ..... 473/454
928,674 A * 7/1909 Lenz ..... 473/454
1,592,005 A * 7/1926 Rovane ..... 473/454
2,126,102 A * 8/1938 Fowler ..... 473/456
2,580,799 A * 1/1952 Lauterbach ..... 473/476
3,039,770 A * 6/1962 Ferretti ..... 473/454
3,312,467 A * 4/1967 Dawson ..... 473/454
3,583,703 A * 6/1971 Brown et al. ..... 473/456
3,878,590 A * 4/1975 Bolger ..... 47/44
3,997,158 A 12/1976 Britton
4,092,023 A * 5/1978 Hazen ..... 473/454
4,295,648 A * 10/1981 Stromback ..... 473/456
4,303,241 A 12/1981 Burroughs
4,318,525 A * 3/1982 Welch ..... 248/228.7
4,473,227 A * 9/1984 Klaus ..... 473/454
D276,952 S * 1/1985 McCully ..... D11/202
4,783,070 A * 11/1988 Bauer et al. ..... 473/453
4,872,674 A * 10/1989 Deal ..... 473/435
4,955,607 A * 9/1990 Maye ..... 473/456
5,195,744 A 3/1993 Kapp et al.
5,320,343 A * 6/1994 McKinney ..... 473/417
5,348,291 A * 9/1994 Scully ..... 473/454
5,433,434 A 7/1995 Helmetsie
5,484,145 A * 1/1996 Shriver ..... 473/454
5,505,443 A * 4/1996 Padilla ..... 473/417
5,511,775 A * 4/1996 Parks ..... 473/454
5,704,855 A * 1/1998 Kellogg, Jr. ..... 473/422
6,093,120 A * 7/2000 Luke, Jr. ..... 473/454
6,458,048 B1 * 10/2002 McGrath ..... 473/421
6,620,065 B2 9/2003 Clabough
7,090,596 B2 8/2006 David
2006/0016442 A1 1/2006 Wilson

* cited by examiner

*Primary Examiner*—Mitra Aryanpour
(74) *Attorney, Agent, or Firm*—Luedeka, Neely & Graham, PC

(57) ABSTRACT

A system for training a batter to automatically swing at pitched balls corresponding to strikes and to refrain from swinging at pitched balls not corresponding to strikes, the device including a visual reference member suspended between a pitcher's mound and a home plate where the batter is located, at a location in front of the plate, so that the trajectory of a pitch from a pitcher's release point proximate the pitcher's mound to a point in a strike zone proximate the home plate consistently passes through a portion of the visual reference member.

2 Claims, 6 Drawing Sheets

BASEBALL BATTER TRAINING SYSTEM

FIELD

This disclosure relates to the field of training aids. More particularly, this disclosure relates to a training system for baseball batters.

BACKGROUND

One of the fundamentals taught to batters in learning to hit a baseball is to be patient and look for a good pitch to hit and not waste a swing on a pitch that is not in the strike zone. Accordingly, what is needed is a system for training batters to swing only at strikes.

Without being bound by theory, it is believed that the system of the disclosure can effectively be utilized to train a user to only swing at pitches that are strikes. For example, it is believed that the conscious analysis limit of the brain is exceeded by a pitched baseball exceeding about 82 mph (130 ft/sec) and a pitched softball exceeding about 63 mph (100 ft/sec). Thus, it is believed that the short loop neural pathways of the brain may be utilized to effectively train a batter to hit baseballs and softballs.

Without being bound by theory, it is believed that the structures and methodologies described herein enable the brain of a user to be trained to provide, in effect, a hitting database hard drive in their brain that is configured for rapid responses by the brain without conscious thought. It has been observed that training of a batter utilizing the structures and methodologies described herein have yielded improved batting performance.

In this regard, the structures and methodologies described herein are configured to train a user to better visually recognize pitches that are strikes and to condition the user to hit good pitches and to not swing at pitches that are not strikes. For example, the structures described herein condition the user to look for motion within defined strike zones areas of a pitched ball and to desensitize the user to the motion of balls that are not strikes and to other motions associated with a pitched ball such as the motion of the pitcher and the like which may distract the user.

SUMMARY

The above and other needs are met by a system for training a batter to automatically swing at pitched balls corresponding to strikes and to refrain from swinging at pitched balls not corresponding to strikes.

In one aspect, the system includes a visual reference member suspended between a pitcher's mound and a home plate where the batter is located, at a location in front of the plate, so that the trajectory of a pitch from a pitcher's release point proximate the pitcher's mound to a point in a strike zone proximate the home plate consistently passes through a portion of the visual reference member.

In another aspect, the disclosure relates to a method for training a batter to automatically swing at pitched balls corresponding to strikes and to refrain from swinging at pitched balls not corresponding to strikes.

According to the disclosure, one training method includes the steps of providing a visual reference member and locating the visual reference member between a pitcher's mound and a home plate where the batter is located, at a location in front of the plate, so that the trajectory of a pitch from a pitcher's release point proximate the pitcher's mound to a point in a strike zone proximate the home plate consistently passes through a portion of the visual reference member; and repeatedly pitching balls along the path toward a batter adjacent the second location.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
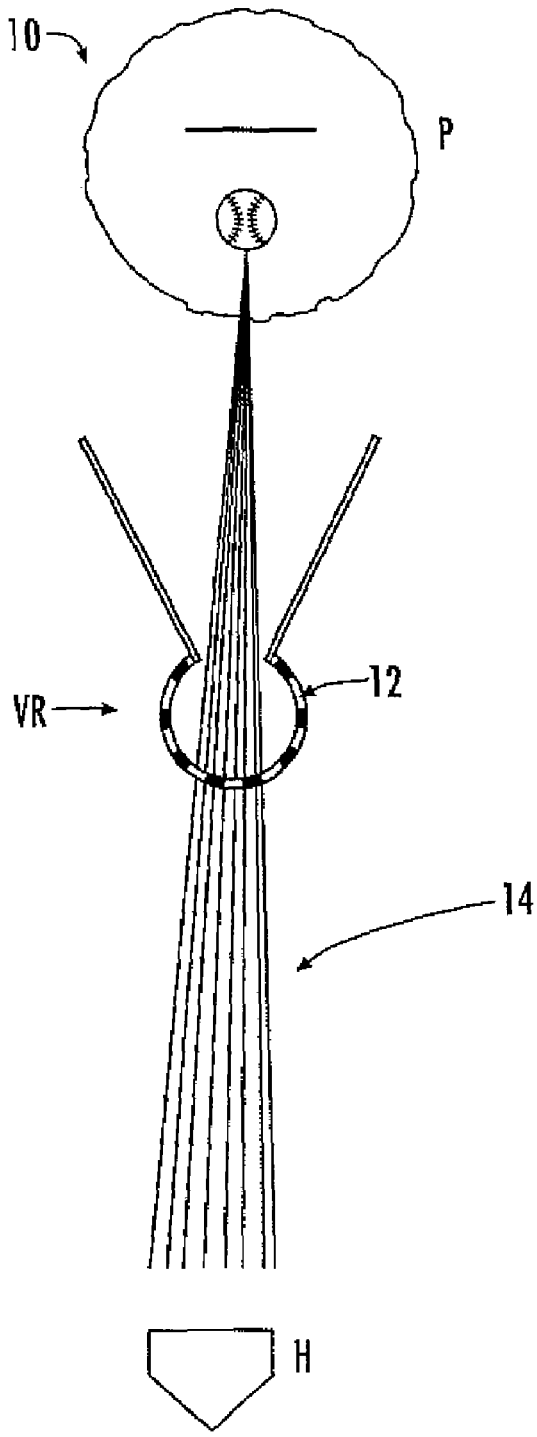
FIG. 1 is a perspective view showing a batter training system according to the disclosure.
Figure 2:
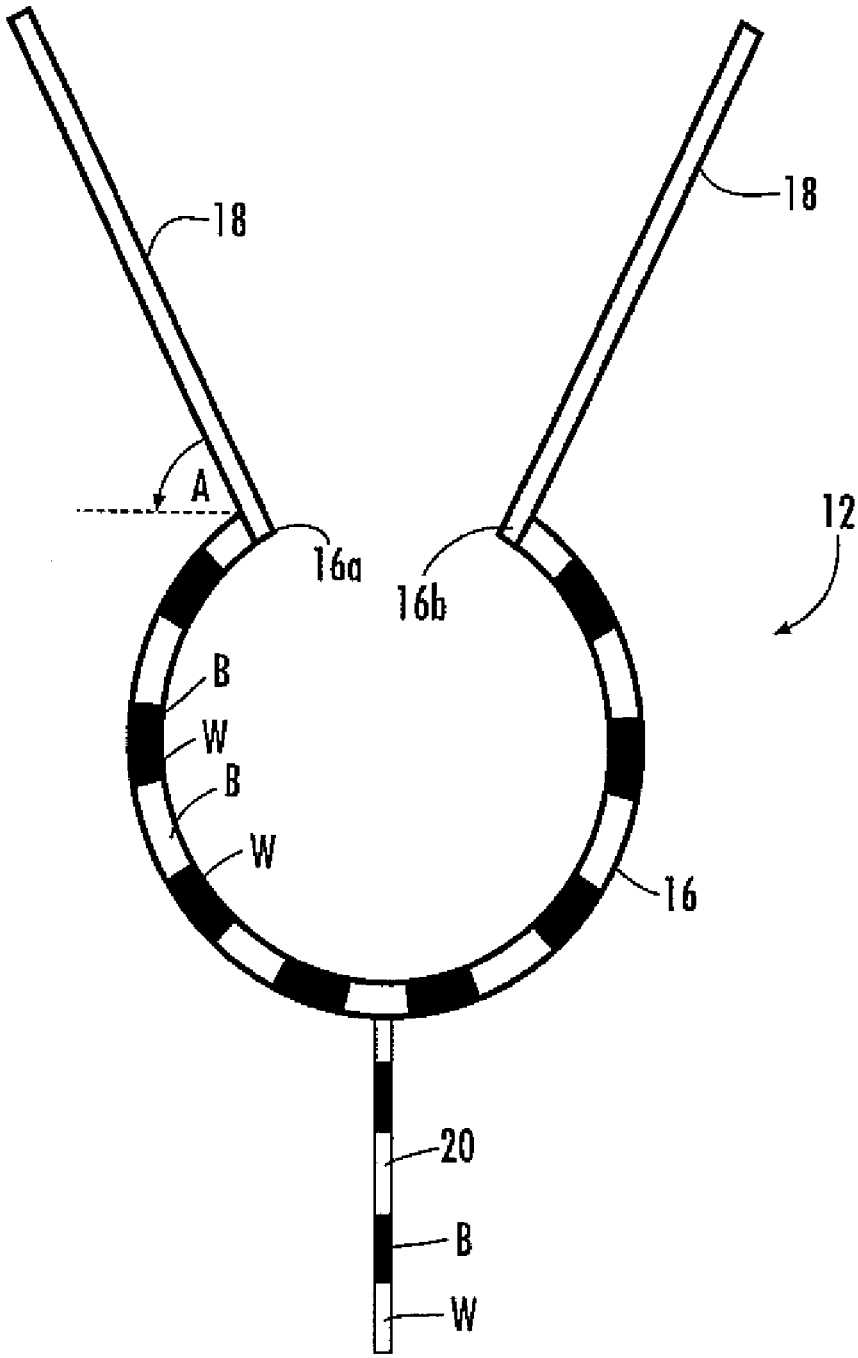
FIG. 2 shows a visual reference member of the system of FIG. 1.

With reference to the drawings, the disclosure relates to a system 10 for training a batter, such as a baseball or softball batter, to more consistently swing at pitches that are within a strike zone and lay off of pitches outside the strike zone. Generally speaking, in baseball, the strike zone is a conceptual rectangular area over home plate which defines the boundaries through which a pitch must pass in order to count as a strike when the batter does not swing. The top of the strike zone is the mid-level between the top of the batter's shoulders and belt, and the bottom is at the level just beneath the knee cap. The right and left boundaries of the strike zone correspond to the edges of home plate.

The disclosure relates to apparatus and methods for training a batter to automatically swing at pitches that will be within the strike zone and to refrain from swinging at pitches outside the strike zone. The automatic swing process developed in the batter also trains the batter to spot strikes earlier. One benefit of this is that the batter has more time to swing and therefore has a better chance of hitting the ball well.

In a preferred embodiment, the system 10 includes a visual reference member 12 positionable at a location VR along a path 14 of a pitched ball extending generally between a first location P corresponding to the release location of a pitched ball and a home plate H, adjacent which the batter is positioned. The visual reference member 12 is utilized to train the batter to learn what strikes look like at various distances from home plate and to condition the batter to automatically swing at strikes and refrain from swinging at all other pitches. The apparatus and methods utilizing the visual reference member 12 facilitate very early recognition of strikes.

The position P corresponds to the release location of a pitched ball. The position P may be adjusted to compensate for pitchers of different heights and different pitching styles so that batters may adjust their training for different pitchers. For example, the height of the position P may be adjusted up or down depending upon the height of the pitcher and the lateral location of the position P may be adjusted to account for variances such as a left or right handed pitcher, a side-arm pitching style, and other characteristics of a pitcher.

The visual reference member 12 may be provided in various configurations, such as squares, circles, and other geometric shapes configured for passage of a pitched baseball from the position P. In one desired example, the visual reference member 12 may be provided by a section of a hoop 16, desirably open at the top thereof, and suspended at the location VR between the positions P and H such that the path 14 passes substantially through the hoop 16. Selection and variance of the location VR is described in more detail below.

For use to train a batter who plays on a regulation baseball field having a distance of about 60 feet 6 inches between the pitcher and home plate, the visual reference member 12, described herein in one context as the hoop 16, may preferably have a diameter of from about 18 to about 24 inches, it being understood that the diameter may be increased or decreased. The member 12 is preferably provided with an open upper end, such as described for the hoop 16. In this regard, ends 16*a* and 16*b* of the hoop 16 are preferably configured so as to be about 12 to about 18 inches apart for a hoop 16 having a diameter of from about 18 to about 24 inches.

The member 12, such as the hoop 16, is suspended at a desired height above the ground along the path 14 as by rope or straps 18 extending from each end of the hoop 16 and attached to overhead supporting devices, such as poles, cables, or the like located to maintain the ropes 18 in the desired orientation. In this regard, it is desired that the ropes 18 extend at an angle A of from about 40 to about 50 degrees relative to the ends 16*a* and 16*b* of the hoop 16. A tensioning strap 20, such an elastic strap, is secured to the bottom of the hoop 16 and is secured to the ground as by a stake or the like. The strap 20 is preferably secured so as to be slightly taut.

The height of the member 12 is determined by the height of the pitcher's arm which corresponds to the position P. Generally, the member 12 is positioned so that the trajectory of a pitch (represented by the path 14) from the position P to the position H will pass through the member 12. Positioning of the member 12 may be accomplished as by stretching a string between the positions P and H. For example, the pitcher will hold his hand at the general release point and the string will be stretched between this point and the center of the strike zone at home plate H. With the string temporarily in position, the member 12 is placed so that the string passes substantially through the center of the member 12. The member 12 may then be suspended at the desired position as by use of the suspension ropes 18 and the tension strap 20.

The relative position of the ball with respect to the visual reference member 12 gives an indication to the batter as to whether the pitch will be a ball or a strike, with this further being a function of the distance of the visual reference member 12 from the batter. After repetitive use of the device, the batter is conditioned to judge whether and where to swing at a pitched ball, and to make this judgment before the ball is actually near the batter. This gives the batter more time to get the bat around on a ball that the batter judges will be a strike.

The surface of the visual reference member 12 facing the batter is provided with alternating dark and light bands, such as alternating black and white bands B and W. This is believed to advantageously increase the visibility of the visual reference member 12 to the batter and makes it easier for the batter to perceive passage of the ball through the visual reference member 12. In this regard, the portions of the visual reference member 12 adjacent the ends are dark and the ropes 18 are white or light so as to contrast with the dark ends and the other dark bands of the visual reference member 12.

It has been observed that the relative dark/light coloration of the portions of the visual reference member 12 and the supporting ropes 18 provides a broken visual image to the user and makes it easier for the batter to perceive passage of the ball through the visual reference member 12. It is believed that upon passage of a ball through the visual reference member 12, the user subconsciously completes the broken visual image.

Figure 3:
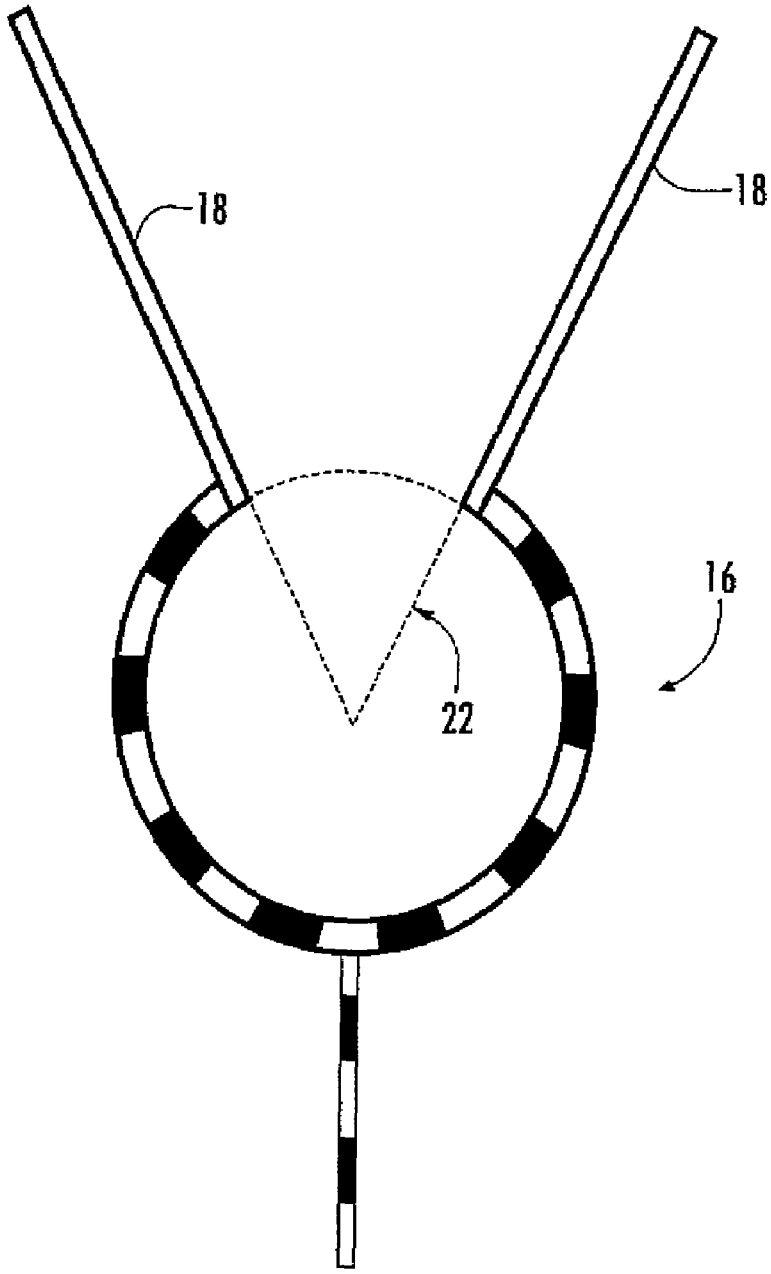
FIG. 3 shows a cone-shaped zone of the visual reference member of FIG. 2 as perceived by a batter.

For example, with reference to FIG. 3, it is believed that the user visually completes the broken image provided by the alternating dark/light bands of the hoop 16 and the ropes 18 to yield a cone-shaped zone 22 within the hoop 16. For a hoop 16 having the above-described dimensions and located from about 14 to about 18 feet in front of the home plate H, it has been observed that substantially all pitches that pass through the cone-shaped zone 22 will be a strike when it reaches the home plate H, regardless of the type of pitch thrown, e.g., fastball, slider, curve ball, sinker, etc. Furthermore, it has been observed that substantially all pitches that are outside of the cone-shaped zone 22 when the hoop 16 is thus located will not be strikes when they reach the home plate H.

Figure 4:
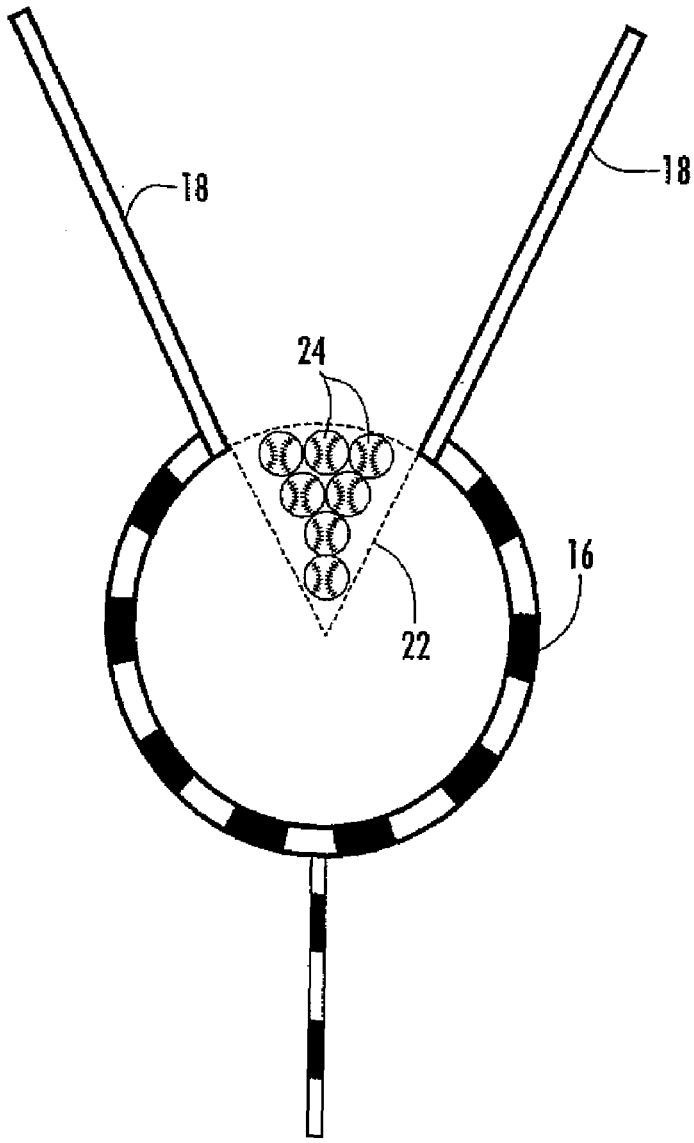
FIG. 4 shows ball locations corresponding to pitched strikes at which the batter should swing.

Accordingly, when the location VR of the thus-described hoop 16 is from about 14 to about 18 feet in front of the home plate H, the cone-shaped zone 22 represents the strike zone and it is desirable to train the batter to swing at any pitch that is within the zone 22 and to refrain from swinging at any pitch that is outside the zone 22. In this regard, and with reference to FIG. 4, the zone 22 is of a size to accommodate about seven baseballs. That is, the batter is instructed to swing at any pitch corresponding to any one of ball locations 24, as the pitch will most likely be a strike. If a pitch does not correspond to one of the ball locations 24, the batter should not swing, as the pitch is most likely not going to be a strike.

Figure 5:
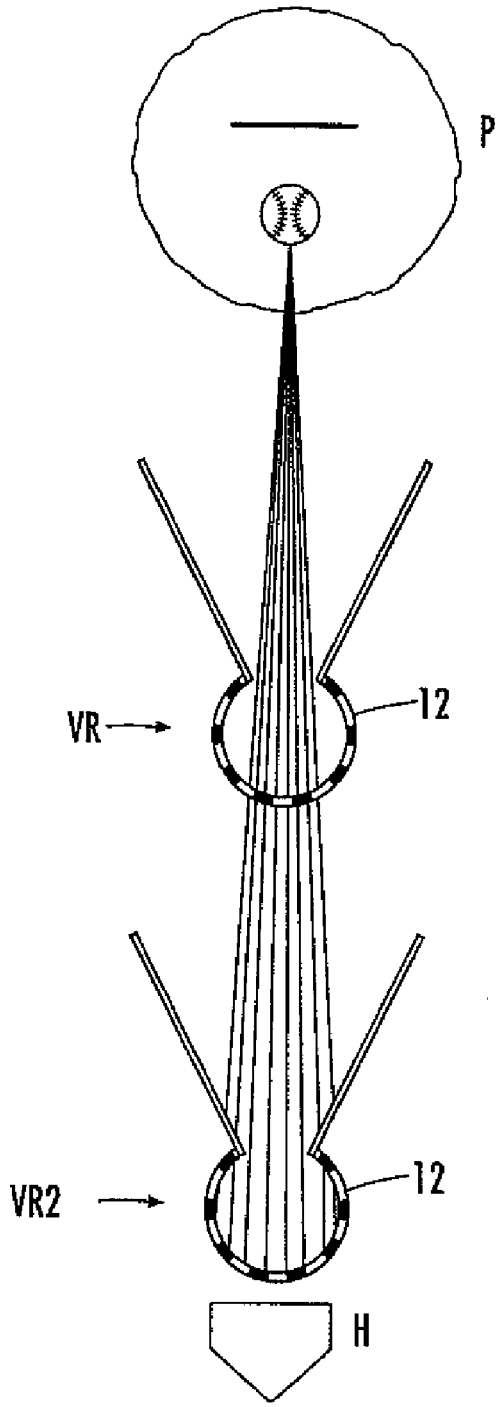
FIG. 5 shows alternate locations of the visual reference member.

As mentioned above, it has been observed that substantially all pitched balls that are within the cone-shaped zone 22, when the location VR of the hoop 16 is selected to be from about 14 to about 18 feet in front of the home plate H, will be strikes when they reach the home plate H. It has further been observed that when the location VR of the hoop 16 is selected to be about 8 feet in front of the home plate H, as represented by location VR2 in FIG. 5, substantially all pitched balls that are within the hoop 16 will be strikes when they reach the home plate H. In this regard, it has been observed that the number of balls that can fit within the hoop 16 is about 35, corresponding to the ball locations represented by reference numeral 26. Thus, any pitched ball corresponding to one of the ball locations 24 when the hoop 16 is at location VR will most likely correspond to one of the ball locations 26 when the hoop 16 is at location VR2. It will be understood that forms of the visual reference member 12 other than the hoop 16 will have similar ball locations and zones that vary based on the distance of the visual reference member 12 from the batter.

To train the batter to swing only at pitches that will most likely be strikes, it is desirable to train the batter to recognize early in the travel of the pitch along the path 14 whether or not such pitch is one to hit or not. In this regard, according to the methodologies of the disclosure, it is desired to train the batter to swing at pitches within the cone-shaped zone 22 at the location VR (corresponding to a location of from about 14 to about 18 feet in front of the home plate H) and to refrain from swinging at pitches outside the zone 22 at the location VR. To accomplish this, pitches are made to the batter in various phases, described below as Phase 1, Phase 2, and Phase 3, which represent examples for utilization of the system 10 to train batters. For training beginning batters, such as batters between the ages of about 5 and 10 years of age, it is desirable to utilize Phases 1 and 2. For skilled amateurs, such as batters between the ages of about 11 years and 18 years of age, it is desirable to use Phases 1, 2, and 3. For college and professional baseball players, it is desirable to use Phases 2 and 3.

EXAMPLE 1

Phase 1

Figure 6:
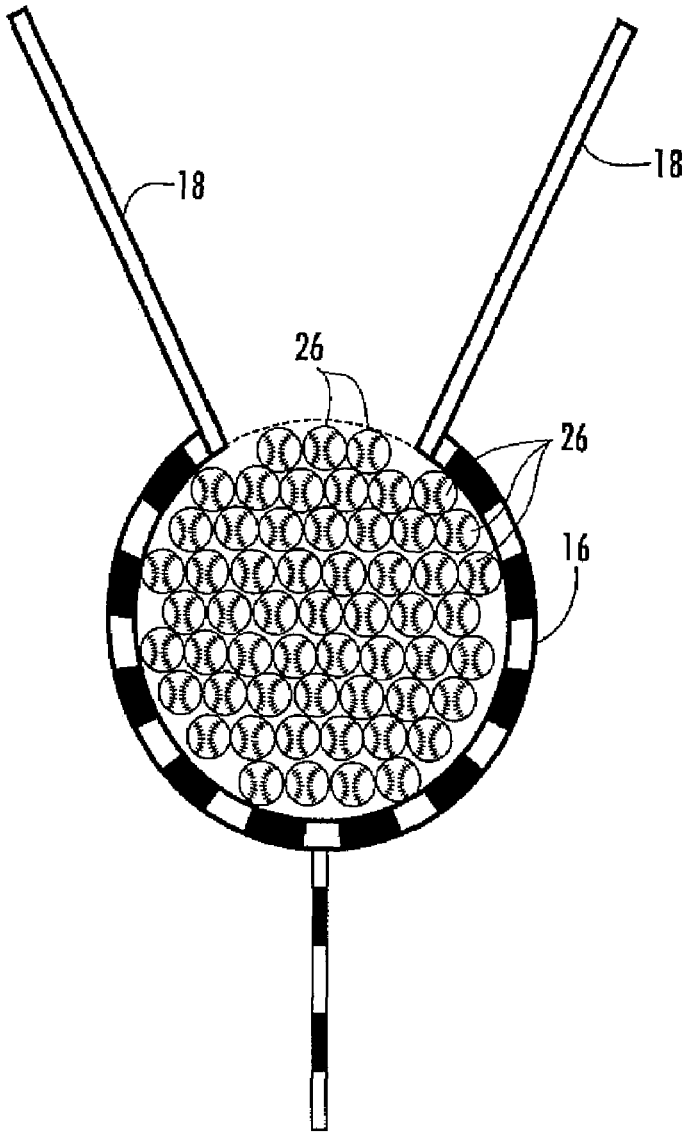
FIG. 6 shows ball locations corresponding to pitched strikes at which the batter should swing when the visual reference member is at the alternate location shown in FIG. 5.

The purpose of Phase 1 training is to train the batter to recognize whether a pitch within about 8 and 20 feet of the home plate is a strike or not and to swing only at strikes. To accomplish this, the hoop 16 (or other visual reference member 12) is located about 8 feet in front of the home plate (corresponding to location VR2 in FIG. 5). The pitcher is located about 20 feet in front of the home plate H, preferably behind an appropriate safety pitching screen, and the height of the hoop 16 is adjusted to correspond to the pitcher. The pitcher preferably pitches a ball underhanded toward the batter at a speed range of from about 10 to about 80 mph, depending upon the skill level of the batter. The pitcher desirably throws balls and strikes in random sequence, with preferably substantially equal numbers of balls and strikes (and a maximum of about three consecutive strikes), with balls preferably being pitched so as to be at least one foot or more outside the hoop 16 and slightly faster than the strikes. The batter is instructed to swing only at pitches that pass through the hoop 16. In this regard, the ball locations 26 described in connection with FIG. 6 will be mentally stored by the batter as balls at which to swing.

EXAMPLE 2

Phase 2

The purpose of Phase 2 training is to train the batter to recognize whether a pitch within about 18 and 40 feet of the home plate is a strike or not and to swing only at strikes. To accomplish this, the hoop 16 (or other visual reference member 12) is located between about 14 and about 18 feet in front of the home plate (corresponding to location VR in FIG. 5). The pitcher is located about 48 feet in front of the home plate H, preferably behind an appropriate safety pitching screen, and the height of the hoop 16 is adjusted to correspond to the pitcher. The pitcher preferably pitches a ball overhanded toward the batter at a speed range of from about 50 to about 85 mph, depending upon the skill level of the batter. The pitcher desirably throws balls and strikes in random sequence, with preferably substantially equal numbers of balls and strikes (and a maximum of about three consecutive strikes), with balls preferably being pitched so as to be at least one foot or more outside the cone-shaped zone 22 and slightly faster than the strikes. The batter is instructed to swing only at pitches that pass through the cone-shaped zone 22. In this regard, the ball locations 24 described in connection with FIG. 4 will be mentally stored by the batter as balls at which to swing.

While Phase 1 and Phase 2 are similar, except for the location of the hoop 16, it is believed that the change in location of the hoop 16 (or other visual reference member 12) provides the batter two points of visual reference data that are distinct in both space and time, which is believed to facilitate training of the batter to team to automatically swing at strikes and to automatically refrain from swinging at non-strikes.

EXAMPLE 3

Phase 3

The purpose of Phase 3 is to train the batter to recognize whether a pitch within about 8 and 16 feet of the home plate is a strike or not and to swing only at strikes. To accomplish this, the hoop 16 (or other visual reference member 12) is located about 8 feet in front of the home plate (corresponding to location VR2 in FIG. 5). The pitcher is located about 16 feet in front of the home plate H, preferably behind an appropriate safety pitching screen, and the height of the hoop 16 is adjusted to correspond to the pitcher. The pitcher preferably pitches a ball overhanded from a kneeling position (or seated on a short stool) toward the batter at a speed range of from about 85 to about 100 mph, depending upon the skill level of the batter. The pitcher desirably throws balls and strikes in random sequence, with preferably substantially equal numbers of balls and strikes (and a maximum of about three consecutive strikes), with balls preferably being pitched so as to be at least one foot or more outside the hoop 16 and slightly faster than the strikes. The batter is instructed to swing only at pitches that pass through the hoop 16. In this regard, the ball locations 26 described in connection with FIG. 6 will be mentally stored by the batter as balls at which to swing. After about eleven pitches, the hoop 16 is removed and about eleven additional pitches are thrown in a similar manner.

To reinforce in the batter's mind the visual images experienced during any of the Phases, it is desired that a batter be allowed a maximum of about 11 swings (not pitches) and a minimum rest period of about 3 minutes between Phases or repetition of a Phase. Preferably, a batter will train with the system every other day. It is believed that repetition of the training phases over time with adequate sleep will condition a batter to automatically swing at strikes and to automatically refrain from swinging at pitches outside the strike zone. The automatic swing process developed in the batter also trains the batter to spot strikes earlier. One benefit of this is that the batter has more time to swing and therefore has a better chance of hitting the ball well.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A system for training a batter to automatically swing at pitched balls corresponding to strikes and to refrain from swinging at pitched balls not corresponding to strikes, the system comprising a visual reference member suspended between a pitcher's mound and a home plate where the batter is located, at a location in front of the plate, so that the trajectory of a pitch from a pitcher's release point proximate the pitcher's mound to a point in a strike zone proximate the home plate consistently passes through a portion of the visual reference member, wherein the visual reference member comprises a hoop section having an upper portion missing to define an open upper end between a pair of exposed ends of the hoop, with a surface of the hoop facing the batter having alternating light and dark bands, with the exposed ends representing two of the dark bands, and the system further includes a pair of light-colored supports located to suspend the hoop above the ground, with the supports extending from the exposed ends of the hoop at an angle of from about 40 to about 50 degrees, wherein when a pitched ball corresponding to a strike passes through a predetermined portion of the hoop the user visually completes the broken image provided by the alternating dark/light bands of the hoop and the supports to yield a cone-shaped zone within the hoop.

2. A method for training a batter to automatically swing at pitched balls corresponding to strikes and to refrain from swinging at pitched balls not corresponding to strikes, the method comprising the steps of providing a visual reference member and locating the visual reference member between a pitcher's mound and a home plate where the batter is located, at a location in front of the plate, so that the trajectory of a pitch from a pitcher's release point proximate the pitcher's mound to a point in a strike zone proximate the home plate consistently passes through a portion of the visual reference member; and repeatedly pitching balls along the path toward a batter adjacent the second location, wherein the step of providing a visual reference member comprises providing a hoop section having an upper portion missing to define an open upper end having a pair of exposed ends, with a surface of the hoop facing the batter having alternating light and dark bands, with the exposed ends representing two of the dark bands, and also providing a pair of light-colored supports and suspending the hoop above the ground at a first location, with the supports extending from the exposed ends of the hoop at an angle of from about 40 to about 50 degrees, wherein when a pitched ball corresponding to a strike passes through the hoop at the first location the user visually completes the broken image provided by the alternating dark/light bands of the hoop and the supports to yield a cone-shaped zone within the hoop.

* * * * *